United States Patent [19]

Nasu

[11] Patent Number: 4,575,066

[45] Date of Patent: Mar. 11, 1986

[54] WEB LAYING MACHINE

[75] Inventor: Nobuo Nasu, Fukuyama, Japan

[73] Assignee: Kabushiki Kaisha Kawakami Seisakusho, Hiroshima, Japan

[21] Appl. No.: 626,974

[22] Filed: Jul. 2, 1984

[30] Foreign Application Priority Data

Jul. 13, 1983 [JP] Japan ..... 58-128109

[51] Int. Cl.[4] ..... B65H 29/46

[52] U.S. Cl. ..... 270/31

[58] Field of Search ..... 270/30, 31

[56] References Cited

U.S. PATENT DOCUMENTS

| | | | |
|---|---|---|---|
| 2,478,840 | 8/1949 | Sayles | 270/31 |
| 3,224,756 | 12/1965 | Obedin | 270/31 |
| 4,021,029 | 5/1977 | Rice | 270/31 |
| 4,477,065 | 10/1984 | Smith et al. | 270/31 |

*Primary Examiner*—E. H. Eickholt

[57] ABSTRACT

The web laying machine comprises a unit for laying cloth or stock material. The unit is mounted on a pivotable casing, support arms support the roll of material, and a transfer roll in juxtaposed relationship with the roll of material effects a pay-off of the material. A spring urges the transfer roll toward and into contact with the roll of material.

10 Claims, 14 Drawing Figures

FIG.8A
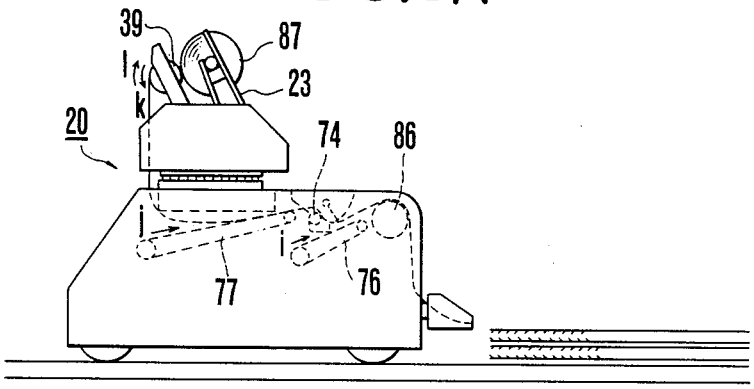
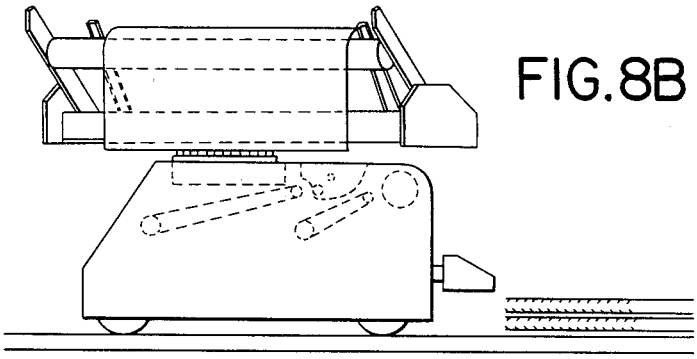
FIG.8B
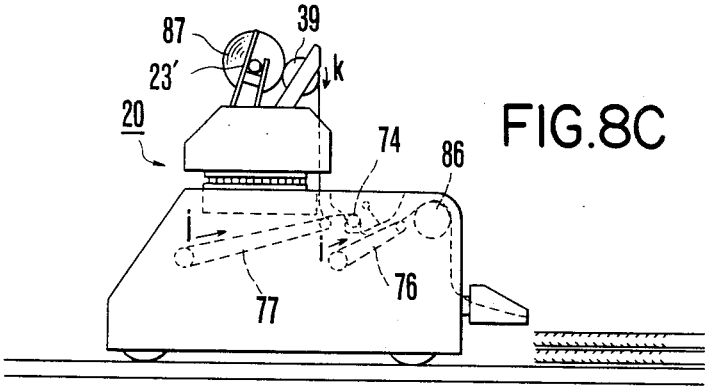
FIG.8C

FIG.9A
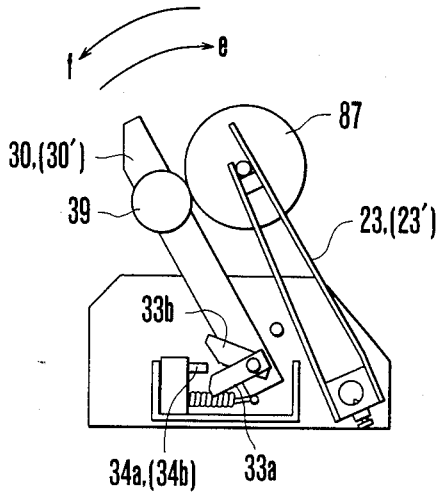
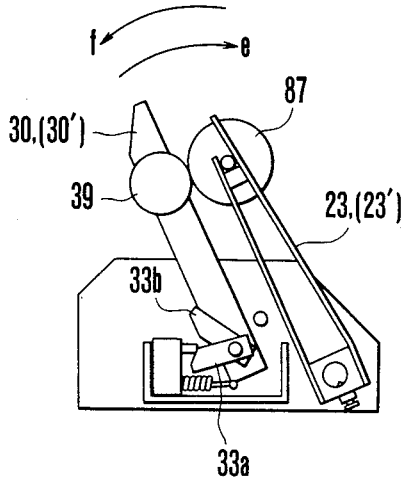
FIG.9B

WEB LAYING MACHINE

BACKGROUND OF THE INVENTION

The invention relates to a web laying machine for laying a web to form superimposed web layers on a laying table which are of a given size so that a plurality of sheets may be cut from a stock material according to a given pattern. Several laying modes are illustrated in FIG. 1 wherein FIG. 1A illustrates a zigzag-folded laying mode, FIG. 1B a simple laying mode which lays the web in one direction, and FIG. 1C a face-to-face laying mode in which a pair of layers are superimposed with each other with their front surfaces P disposed face to face and which is advantageously employed when cutting the stock material for the left and right portions of slacks according to a single paper pattern.

FIG. 2 shows a conventional web laying machine including a layer unit 2 which carries, on its opposite sides, rubbing wheels 3 which engage rails 4 disposed along the both lateral edges of a laying table 1 and which are adapted to be driven for rotation by an electric motor, not shown, disposed within the unit. The unit includes cutting means 4 disposed on the front side thereof and also includes a pair of stock material support arms 6, 6′ which have their free end formed into dual claws g, g′ for supporting an axle of a roll of stock material 7. The pair of support arms 6, 6′ are integrally mounted on a horizontal rod 9 extending through a pivotable casing 8 which is disposed on the rear side of the unit 2. The pivotable casing 8 is rotatable on the unit 2 through 180° in a horizontal plane, as indicated by arrows a and b, in response to a drive from an electric motor, not shown. Also the horizontal rod 9 having the support arms 6, 6′ mounted thereon is rotatable through 180° in a vertical plane, as indicated by arrows c and d. The web laying machine includes a catcher 10 disposed at a given distance forwardly of the laying unit 2 on the table. The catcher includes a retaining lever 11*a* which is locked into abutment against the table 1 at a given position thereof to retain the leading edge m of the stock material or cloth 7 during the reciprocating motion of the laying unit. It will be seen that the laying unit also includes a transfer roll 12, a guide roll 13 and a control panel 14.

In the described web laying machine, the laying unit 2 is adapted to travel back and forth through a given distance along the table in response to a command from the control panel 14. If the cutting means is not operated, a consecutive laying operation in the zigzag-folded mode (see FIG. 1A) takes place. If the cutting means is operated for each reciprocating motion of the laying unit 2 to severe the stock material, a laying operation takes place in the simple mode (see FIG. 1B). A laying operation in the face-to-face mode (see FIG. 1C) can be accomplished by reversing the transfer roller 12 subsequent to the severage of the cloth to take up the cut end on the stock material shaft, then raising the support arms 6, 6′ upward, and rotating the pivotable casing 8 through 180°.

It will be noted that the laying operation in either the zigzag-folded mode and the simple mode can be performed continuously as the machine is initially set up while the laying operation in the face-to-face mode is interrupted by a manual resetting operation which is required after each rotation of the pivotable casing before another length of the stock material can be laid out, since the cut edge of the stock material must be once taken up on the stock material shaft after each completion of the reciprocating motion of the laying unit 2, followed by the rotation of the pivotable casing through 180°. Such manual operation substantially degrades the operational efficiency.

SUMMARY OF THE INVENTION

The invention intends to overcome the problem described above. Specifically, in the arrangement of the invention, a transfer roll which effects a pay-off of a cloth or stock material from a roll thereof, including support arms associated therewith, is mounted on a pivotable casing in juxtaposed relationship with a pair of support arms which support the roll of stock material. The support arms associated with the transfer roll are normally biased by springs to urge it into contact with the roll of stock material with a resilient force of a given magnitude.

BRIEF DESCRIPTION OF THE DRAWINGS

FIGS. 8 and 9 are illustrations of the operation of the arrangement.

DESCRIPTION OF PREFERRED EMBODIMENT

Figure 1A:
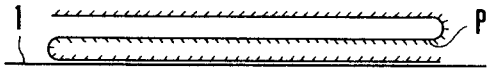
FIGS. 1A, B and C are schematic illustrations of several modes of laying a web.
Figure 1B:
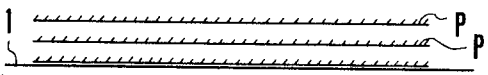
Figure 1C:
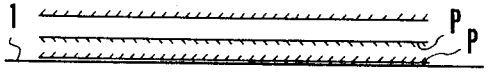
Figure 2:
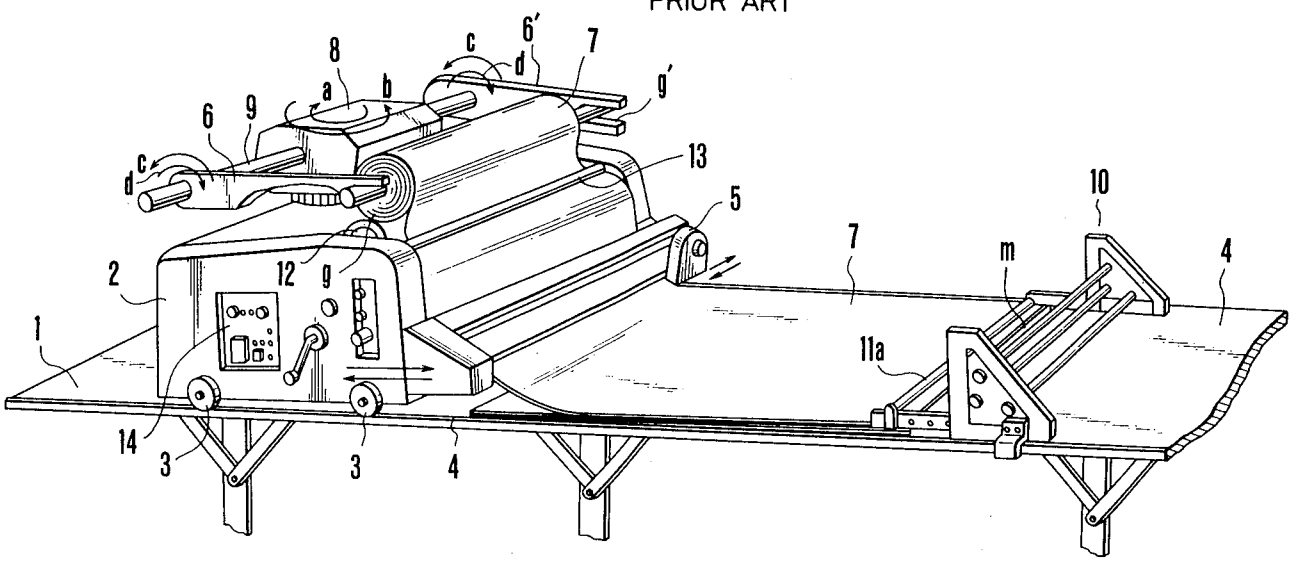
FIG. 2 PRIOR ART
FIG. 2 is a perspective view of a conventional web laying machine, as viewed from the front side thereof.
Figure 3:
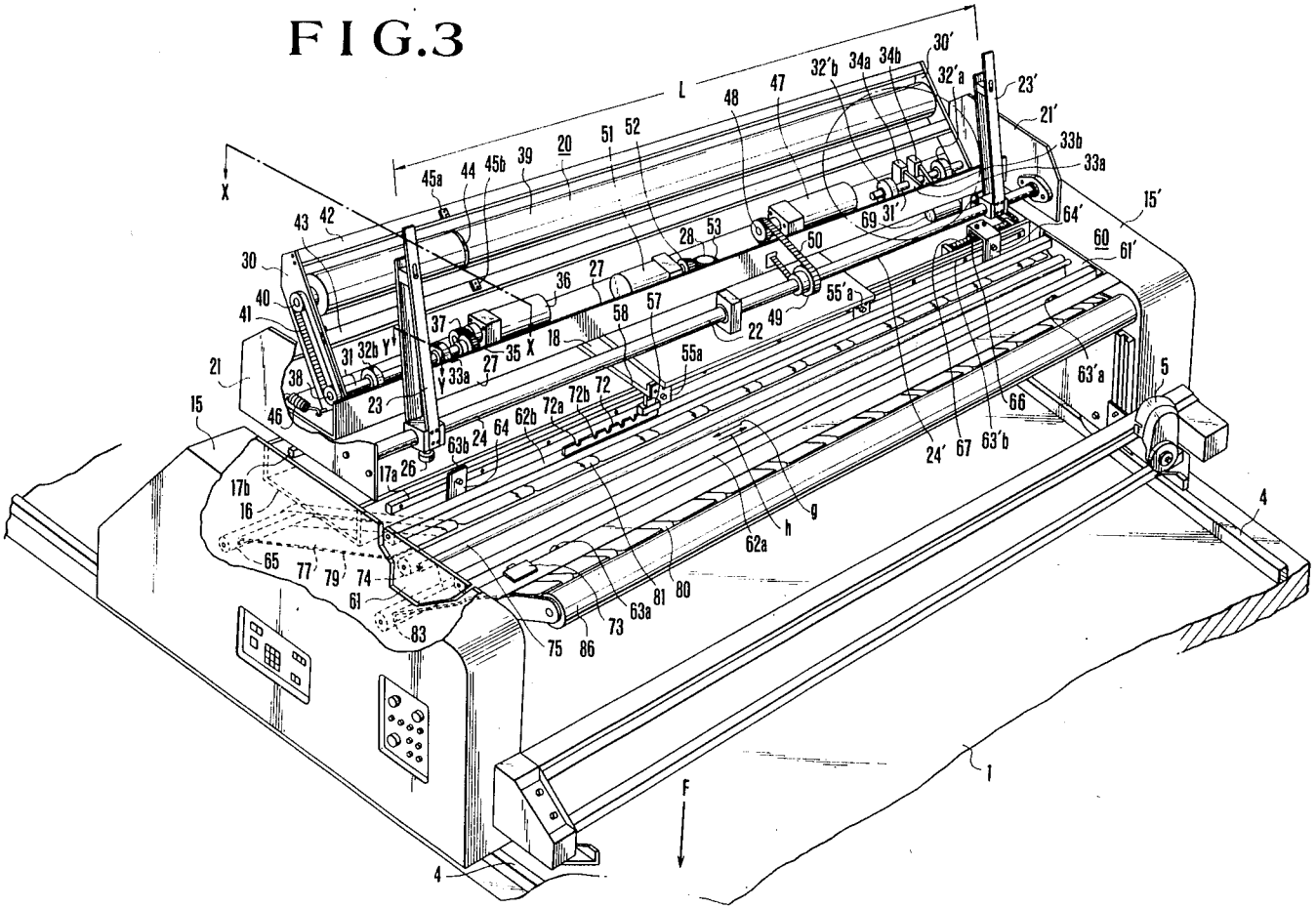
FIG. 3 is a perspective view of an overall arrangement according to one embodiment of the invention.
Figure 4:
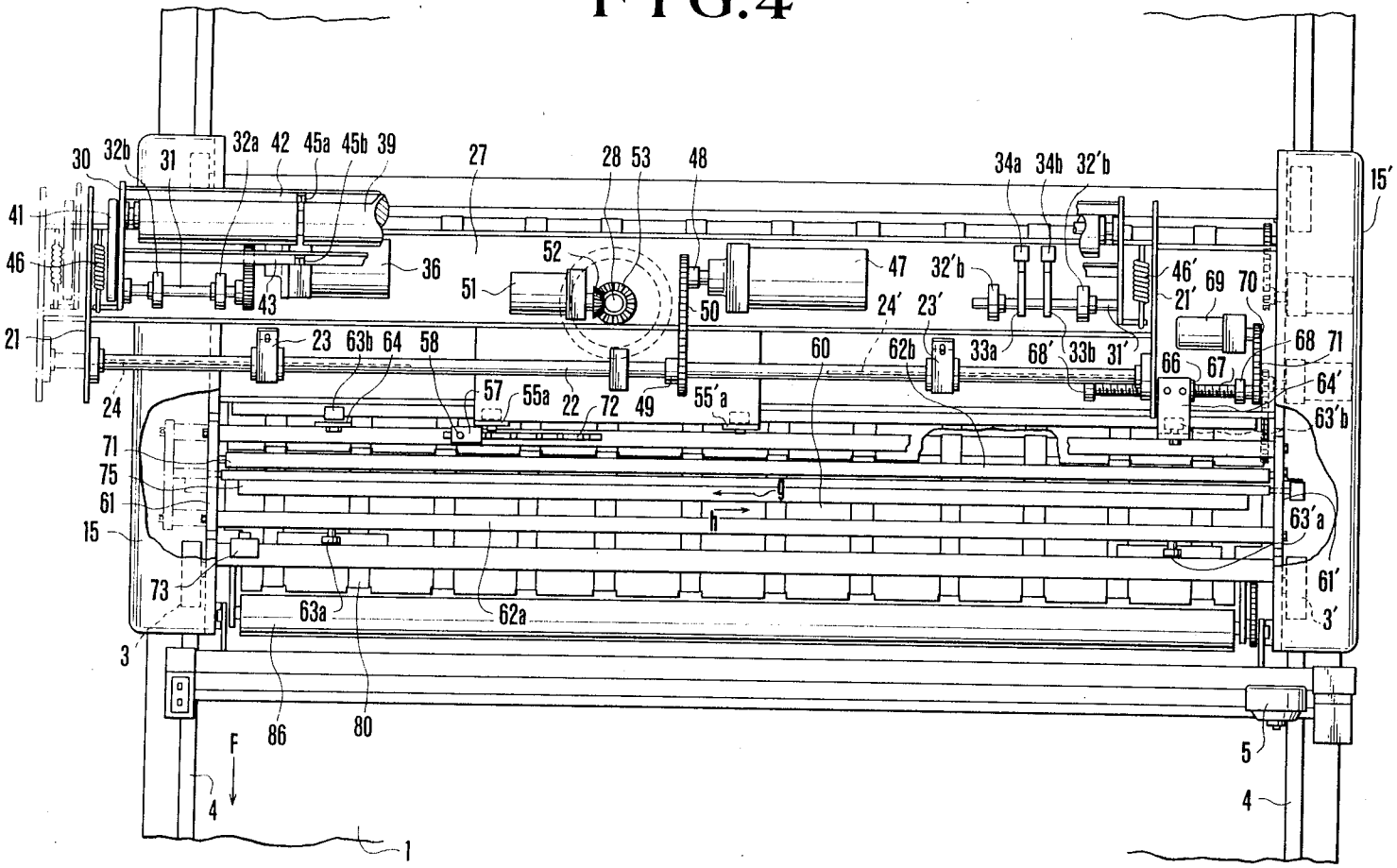
FIG. 4 is a plan view of the arrangement shown in FIG. 3.
Figure 5:
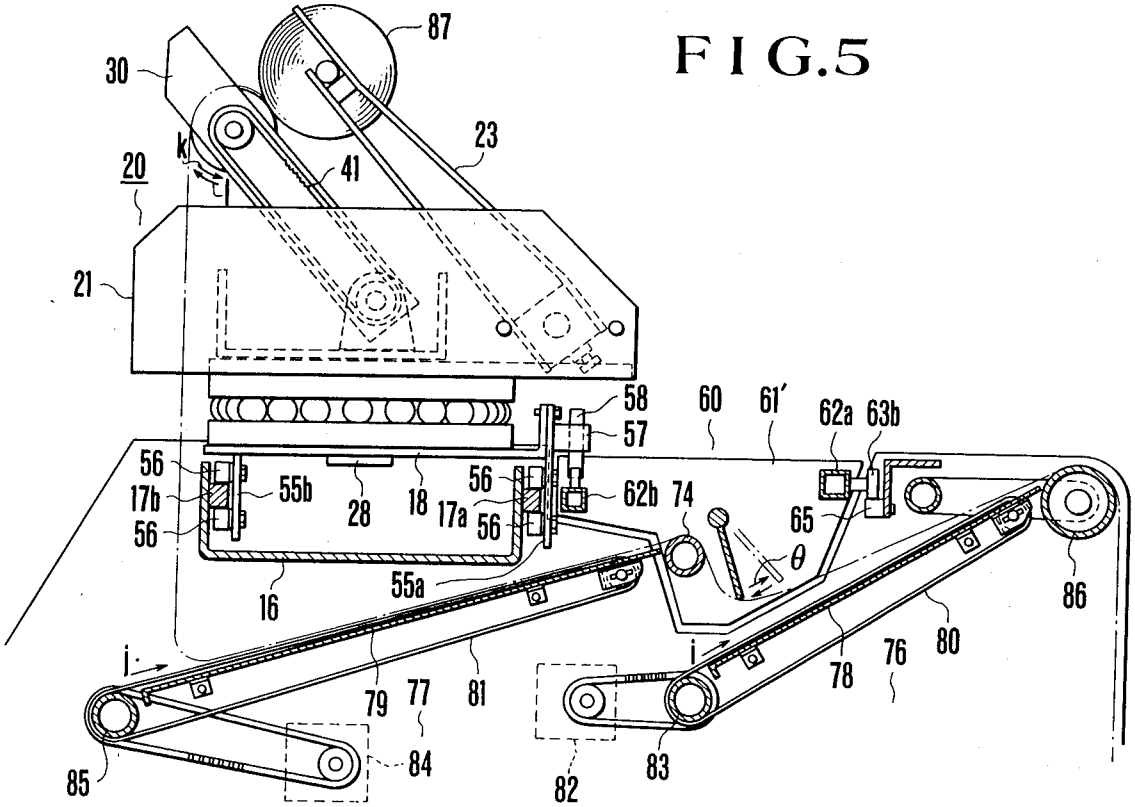
FIG. 5 is a side elevation, partly in section, taken along the line X—X shown in FIG. 3.
Figure 6:
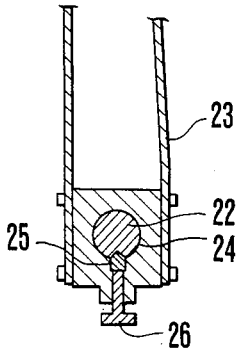
FIG. 6 is a side elevation, partly in section, taken along the line Y—Y shown in FIG. 3.
Figure 7:
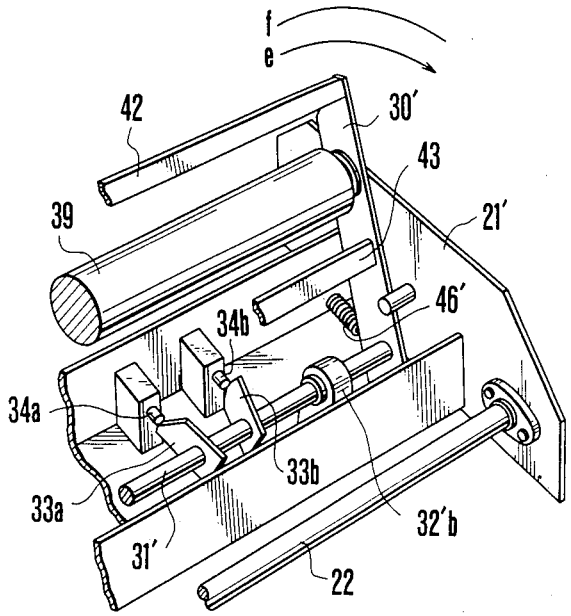
FIG. 7 is an enlarged perspective view of an area encircled by phantom line in FIG. 3.

Referring to the drawings, the web laying machine includes a laying unit defined by a pair of sidewalls 15, 15′, and an interconnecting frame 16 of a channel configuration in section and bridging across the top of the sidewalls 15, 15′. A pair of rails 17*a*, 17*b* are mounted on the outer and the inner surface of limbs of the channel-shaped frame, and a horizontal base 18 which rotatably carries a pivotable casing, to be described later, is slidably disposed on these rails.

In the arrangement of the invention, a pivotable casing 20 includes a pair of sideplates 21, 21′ disposed in opposing relationship with each other and which are spaced apart by a distance substantially equal to the length of the frame 16. An arm shaft 22 is rotatably journalled in these sideplates at the forward end thereof. A pair of support arms 23, 23′ are mounted on the arm shaft 22 so as to be slidable axially thereof, and are generally located adjacent to the opposite ends thereof. The spacing L between the support arms 23, 23′ can be chosen to any desired value, which can be maintained by forming keyways 24, 24′ in the arm shaft over a given length adjacent to each of the opposite ends thereof, with keys 25 extending from the bottom of the support arms 23, 23′ being fitted into the keyways and secured therein by means of set screws 26.

The pivotable casing includes a mount 27 which is channel-shaped in section and located adjacent to rear portions of the sideplates 21, 21′. A pivot 28 is mounted on the mount at the center position, as viewed along the length thereof, and is mounted on the horizontal base 18 by means of thrust bearing means 29. A pair of transfer roll arms 30, 30' are disposed adjacent to the opposite ends of the mount 27 so as to be rockable over a given angular range. Specifically, these arms are mounted on shafts 31, 31' which are rotatably received by pairs of bearings **32*a*, 32*b* and 32'*a*, 32'*b* which are in turn secured to the mount 27. The shaft 31' is formed integrally with the root of the transfer roll arm 30'. The shaft 31' fixedly carries a pair of switch cams 33*a*, 33*b*, located intermediate the bearings 32'*a* and 32'*b*, for contact with a pair of limit switches 34*a*, 34*b* which are in turn fixedly mounted on the mount 27 at angles which are different from each other. In the arrangement shown, when the switch cam 33*a* engages the limit switch 34*a*, the rocking motion of the transfer roll arms in a direction indicated by an arrow e is limited to a preset angle. On the other hand, when the switch cam 33*b* engages the limit switch 34*b***, the rocking motion of the transfer roll arms in a direction indicated by an arrow f is limited to another preset angle. This assures that the pressure of contact with a roll of stock material which is carried by cloth holding arms be maintained within a given range.

On the other hand, the shaft 31 is mounted so as to be freely rotatable with respect to the root of the transfer roll arm 30. Specifically, a gear 35 is mounted on an end of the shaft 31 which is located within the mount 27 remote from the sideplate 21, and meshes with a drive gear 37 mounted on the output shaft of a motor 36 which is attached to the mount 27, whereby the shaft 31 can be rotated. A pulley 38 is mounted on the other end of the shaft 31 outside the transfer roll arm 30.

A transfer roll 39 extends across and is rotatably journalled in the transfer roll arms 30, 30' adjacent to the free ends thereof. At its one end, the axis of the transfer roll 39 projects outside the sideplate 21 and fixedly carries a pulley 40 thereon. A belt 41 extends around the pulleys 38, 40, thus allowing the rotation of the shaft 31, as driven by the motor 36, to be transmitted to the transfer roll 39 through the belt 41. A pair of stays 42, 43 extend across and are connected to the arms 30, 30' in order to maintain a given distance therebetween. A groove 44 extending to the axis of the transfer roll 39 is formed therein, and a light projector **45*a* and a light receiver 45*b*, which form a photoelectric switch, are mounted on the stays 42, 43 so as to be in alignment with each other on the opposite sides of the groove 44. The purpose of the photoelectric switch is to detect an edge of cloth hanging from the roll of stock material during the initial phase of operation, thereby automatically determining the direction in which the transfer roll 39 is to be rotated. A pair of springs 46, 46' have their one end connected to the lower end of the respective transfer roll arms 30, 30' and their other ends connected to the mount 27, thereby normally urging the transfer roll 39, which is journalled between the transfer roll arms 30, 30', to rotate in a direction indicated by an arrow e, thus into contact with a roll of stock material which is to be received on the support arms 23, 23'**.

A motor 47 is mounted on the mount 27 and is closely spaced from the rotatable pivot 28 which is disposed at the center of the mount. A chain wheel 48 is mounted on the end of the motor shaft, and another chain wheel 49 is mounted on the arm shaft 22 at a position corresponding to the chain wheel 48. A chain 50 extends around the both chain wheels to cause a rotation of the arm shaft 22. In this manner, the rotation of the motor 47 in either forward or reverse direction causes the support arms 23, 23', which are integrally mounted on the opposite ends of the arm shaft 22, to rotate incrementally in either directions indicated by arrows e or f. Such rotation takes place in conjunction with the engagement or disengagement of the switch cams **33*a*, 33*b* with or from the limit switches 34*a*, 34*b*. Specifically, when the switch cam 33*a* engages the limit switch 34*a*, the motor 47 rotates in the forward direction to cause the support arms 23, 23' to rotate in the direction indicated by the arrow f. As the switch cam 33*a* is disengaged in response to such rotation, the motor 45 comes to a stop. On the other hand, the engagement of the switch cam 33*b* with the limit switch 34*b* causes the motor 47 to rotate in the reverse direction, thus incrementally rotating the support arms 23, 23'** in the opposite direction or the direction indicated by the arrow e.

Another motor 51 is mounted on the mount 27 on the opposite side of the rotatable pivot 28 from the motor 47. A drive from the motor 51 causes the mount 27 to rotate through 180°. Such rotation is achieved by a meshing engagement of a bevel gear 52 mounted on the end of the motor shaft with a bevel gear 58 which is journalled perpendicular to the mount 27.

Pairs of brackets **55*a*, 55'*a* and 55*b*, 55'*b* depend from the front and the rear edge of the horizontal base 18, and each carries rollers 56 for engagement with the rails 17*a*, 17*b* to allow a sliding movement therealong. A set plate 57 is mounted on the front surface of the bracket 55*a* and includes a pin 58** which is received therein so as to be movable in the vertical direction and which is adapted to engage one of steps forxed in a key plate which is formed on a cloth receiver.

A cloth receiver 60 is disposed forwardly of the pivotable casing 20, and is disposed to be movable in a direction laterally of the sidewalls 15, 15'. Specifically, it includes a pair of sideplates 61, 61' which are of a size commensurate with and are disposed in opposing relationship with the sideplates 21, 21' of the pivotable casing. A pair of horizontal rods **62*a*, 62*b* extend across and interconnect the both sideplates. The front horizontal rod 62*a* carries rollers 63*a*, 63'*a* while the rear horizontal rod 62*b* fixedly carries brackets 64, 64', on which rollers 63*b*, 63'*b* are mounted. The rollers 63*a*, 63'*a* are placed on a rail 65 which is disposed on the laying unit 2 toward the front end thereof while the rollers 63*b*, 63'*b* are placed on the rail 17*a* which is mounted on the front side of the interconnecting frame 16. It is to be noted that the bracket 64' has an inverted U-configuration and the free end of one limb thereof is located within the interconnecting frame 16, with a boss 66 which is formed with a female thread integrally mounted thereon to receive a screw 67 by threadable engagement. A pair of bearings 68, 68' are mounted on the interconnecting frame to receive the screw 67. A motor 69 is provided, and its rotation in the forward or the reverse direction is transmitted through gears 70, 71 to cause the screw 67 to rotate, thereby driving the cloth receiver 60 in mutually opposite directions indicated by arrows g and h. As mentioned previously, the rear horizontal rod 62*b* is provided with a key plate 72 having notches 72*a*, 72*b*, 72*c* . . . formed therein. When the pin 58 is engaged with one of these notches, the pivotable casing 20 is movable together with the movement of the cloth receiver 60**.

In the arrangement of the invention, the ability of the horizontal base 18 of the pivotable casing 20 to move laterally with respect to the interconnecting frame 16 brings forth an advantage that the selvage of the cloth can normally be aligned with one of the lateral edges of the laying table 1 which is located on the operating side of the arrangement or F position, independently from the size or width of the roll of stock material, thereby improving the operational efficiency. Accordingly, at the outset when loading the roll of stock material, the support arms 23, 23' are suitably adjusted so that they are located symmetrically with respect to the rotatable pivot 28, and the horizontal base 18 is moved within the interconnecting frame 16 while maintaining the pin 58 in its raised position. The pin 58 is engaged with one of the notches 72*a*, 72*b*, 72*c* . . . formed in the key plate 72 when one of the selvages of the roll of stock material supported in this manner is aligned with a given mark line inscribed on the laying table 1.

A selvage detecting sensor 73 operates to drive the motor 69 in a manner to maintain the selvage aligned with a designated position as the cloth is paid off from the roll of stock material, thereby moving the pivotable casing 20 and the cloth receiver 60 together. A first feed roller 74 is journalled between the sideplates 61, 61' and is driven for rotation by means not shown. A dancer lever 75 extends across the sideplates 61, 61' and is mounted in a rockable manner for controlling the drive to the motor 36 and hence the angle of the transfer roll 39 in response to a change in the angle of oscillation $\theta$ as the cloth is paid off to extend between the first feed roller 74 and a second feed roller, to be described later. The control is such that the movement takes place at an increased rate for an increased up-directed angle $\theta$ and at a decreased rate for a smaller angle.

A pair of front and rear conveyor belt assemblies 76, 77 are disposed across the pair of sidewalls 15, 15' of the laying unit. Each of the conveyor belt assemblies comprises a plurality of endless belts 80, 81 which are spaced apart at a suitable spacing over plates 78, 79. The assembly 76 is driven by a motor 82 which rotates a roller 83 while the assembly 77 is driven by a motor 84 which rotates a roller 85. In this manner, the individual belts are driven in directions indicated by arrows i and j. Accordingly, the cloth paid off the roll is carried on the belt forwardly on the laying unit. The second feed roller mentioned above which is located forwardly of the laying unit is indicated at 86.

In operation, FIG. 8 illustrates the laying operation in the face-to-face mode. The roll of stock material 87 is carried by the support arms 23, 23', and the transfer roll 39 is driven for rotation in a direction indicated by an arrow k while maintaining its contact with the roll 87. As a result, the cloth is paid off from the roll, and the conveyor belt assemblies 76, 77 are simultaneously energized for movement in directions indicated by arrows i and j, whereby the cloth is fed forward over the first and the second feed roller 74, 86 onto the laying table 1.

The laying operation is performed by running the laying unit along the laying table 1. When the laying operation in one direction is terminated, the transfer roller 39 ceases to rotate. Subsequently the cloth is severed, whereupon the transfer roller 39 is reversed to rotate in a direction indicated by an arrow l, whereby the cloth is taken up on the roll 87. However, it should be noted that the amount of take-up is small, and the rotation of the transfer roll 39 is interrupted when the cut end hangs down onto the laying unit. An approximate time interval which is required for such hanging condition to be achieved may be preset in a timer to reverse the motor 36. Alternatively, a photoelectric switch, not shown, may detect the hanging condition to stop the drive to the motor 36.

As shown in FIG. 8B, the pivotable casing is then rotated through 180°, whereupon the motor 36 is again driven in the forward direction, thereby rotating the transfer roll 39 in the direction of the arrow k, as indicated in FIG. 8C, thus paying the cloth off the roll. The cloth then is passed over the upper edge of the conveyor belt assembly 76, the first feed roller 74, the other conveyor belt assembly 76 and the second feed roller 86, whereby the cloth being laid out is in the opposite orientation from that shown in FIG. 8A. When this laying operation is completed, the cloth is severed, whereupon the transfer roll 39 is reversed in rotation, and its motion is interrupted when the cloth hangs down onto the laying unit. Subsequently, the pivotable casing 20 is again rotated through 180° to return the arrangement to the condition shown in FIG. 8. The cycle then repeats itself.

The diameter of the cloth on the roll 87 decreases in a gradual manner during the laying operation, and this requires a regulation as illustrated in FIG. 9. Initially, the combination of the roll 87 and the transfer roll 39 performs a pay-off of the cloth while the switch cams 33*a*, 33*b* are both out of contact with the limit switches 34*a*, 34*b* as indicated in FIG. 9A. When the diameter of the roll 87 decreases, the transfer roll arms 30, 30' rotate in the direction of the arrow e, as indicated in FIG. 9B, whereby the switch cam 33*a* moves into contact with the limit switch 34*a*, thus driving the motor 47 to rotate the support arms 23, 23' in the direction indicated by the arrow f. Such rotation causes the transfer roll arms 30, 30' to rotate in the direction of the arrow f against the resilience of the springs 46, 46', thus moving the switch cam 33*a* away from the limit switch 34*a*, whereupon the motor 47 is immediately deenergized, and the arrangement returns to the condition shown in FIG. 9A. Such operation is subsequently repeated to assure that the cloth be paid off from the roll under a given pressure of contact.

The function of the switch cam 33*b* and the limit switch 34*b* in the arrangement of the invention will be seen when considering the laying operation where an increased length of cloth which has once been paid off from the roll 87 is to be taken up thereon again. Specifically, when the take-up of the cloth results in an increased diameter of the roll of stock material to rotate the transfer roll arms 30, 30' in the direction of the arrow f, the switch cam 33*b* moves into contact with the limit switch 34*b*, thus reversing the motor 47. This serves rotating the support arms 23, 23' in the direction of the arrow g, whereby the switch cam 33*b* moves away from the limit switch 34*b*. The disengagement of the switch cam from the limit switch ceases the drive to the motor 47. Subsequently, a similar operation is repeated to assure that the cloth be taken up on the roller under a given pressure. It is to be noted that what has been described immediately above refers to an operation to take up an increased length of cloth, in contradistinction to the take-up operation which is normally performed during the laying operation in the face-to-face mode in order to avoid an interference with the rotation of the pivotable casing.

It will be seen from the foregoing description that it is only necessary to load the roll of stock material 87 on the support arms 23, 23' by a manual operation during the initial phase of the laying operation, but that the subsequent laying operation takes place in a full automatic manner. It will also be seen that it is unnecessary to take up the cloth completely on the roll of stock material during the rotation of the pivotable casing, thereby reducing the time length required for the switching operation and thus substantially improving the production efficiency.

It will be appreciated from the above description that the arrangement of the invention has a particular applicability to the laying operation in the face-to-face mode, but it should be understood that the invention is also applicable to the laying operation in the zigzag-folded mode or the simple mode which does not require a rotation of the pivotable casing, allowing such operation to be performed freely and in a simplified manner.

What is claimed is:

1. A web laying machine comprising a laying unit adapted for forward and backward movement, the laying unit including a pair of sidewalls and an interconnecting frame extending across and connected to the pair of sidewalls, a horizontal base slidably disposed on the interconnecting frame and capable of movement on the frame in a direction substantially perpendicular to the direction of movement of the laying unit, a pivotable casing rotatably mounted on the horizontal base and including a pair of support arms which define a given distance therebetween across which a roll of stock material is to be received, a transfer roll disposed in juxtaposed relationship with the pair of support arms for paying off a cloth from the roll of stock material and support arms associated with the transfer roll, and spring means for normally urging the transfer roll toward and into contact with the roll of stock material with a given resilent bias.

2. A web laying machine comprising:

a flat surface;

a laying unit for mounting on the flat surface and adapted to move in a forward and backward direction thereon, the laying unit including: a first pair of support arms adapted to support a roll of textile fabric therebetween; a second pair of support arms upon which is mounted a transfer roller having an axis substantially parallel to the axis of the fabric roll, the roll of fabric and transfer roller being contiguous each other; a first regulating means for adjusting the position of the first pair of support arms; a second regulating means for adjusting the position of the second pair of support arms, wherein the fabric roll and a transfer roller are moved toward or away from each other by the first and second pair of support arms respective in dependence upon the changing diameter of the fabric roll so that the pressure between said fabric roll and transfer roller is substantially constant.

3. A web laying machine as claimed in claim 2 wherein the first and second pairs of support arms are each mounted on a rotatable shaft.

4. A web laying machine as claimed in claim 3 wherein the first regulating means is a motor operatively connected to the rotatable shaft upon which the first pair of support arms are mounted.

5. A web laying machine as claimed in claim 3 wherein the second regulating means comprises biasing means acting on the second pair of support arms so as to rotatively urge the second pair of support arms towards the first pair of support arms.

6. A web laying machine as claimed in claim 5 wherein the biasing means comprises one or more springs, each spring being connected at one end to one of the second support arms, the other end of the spring being connected to the laying unit.

7. A web laying machine as claimed in claim 3 further comprising a switch cam on the second pair of support arms, and a limit which switch operated by the switch cam, the limit switch being activated by the switch cam according to the angular position of the second pair of support arms, the angular position of the pair of support arms being determined by the width of the fabric roll on the first pair of support arms.

8. A web laying machine as claimed in claim 7 wherein the limit switch activates the first regulating means, the first regulating means thereby adjusting the angular position of the first pair of support arms in dependence of the width of the fabric roll.

9. A web laying machine as claimed in claim 2 wherein the laying unit includes pair of sidewalls, an interconnecting frame extending between the sidewalls, and a horizontal base slidably mourted on the interconnecting frame for movement thereon in a direction substantially perpendicular to the direction of movement of the laying unit.

10. A method of laying a web with a web laying machine comprising the steps of:

providing a first pair of support arms for carrying a fabric roll;

providing a second pair of support arms for carrying a transfer roller, the axes of the fabric roll and transfer roller being parallel;

providing a first regulating means for adjusting the position of the first pair of support arms;

providing a second regulating means for adjusting the position of the second pair of support arms, wherein the first and second regulating means regulate the position of the first and second pairs of support arms independence upon the changing width of the fabric roll so that the fabric roll and transfer roller are held adjacent each other with a substantially constant pressure while the width of the fabric roll decreases or increases by paying out or taking in fabric.

* * * * *